US005689929A

United States Patent [19]

Newsom

[11] Patent Number: 5,689,929

[45] Date of Patent: Nov. 25, 1997

[54] EARTHQUAKE AND WEATHER RESISTANT, FAIL-SAFE CONSTRUCTION BLOCK

[75] Inventor: Bob G. Newsom, Virgie, Ky.

[73] Assignee: Advanced Building Technologies, Inc., Olive Hill, Ky.

[21] Appl. No.: 542,131

[22] Filed: Oct. 12, 1995

[51] Int. Cl.[6] ..... E04H 12/00

[52] U.S. Cl. ..... 52/648.1; 52/561; 52/578; 52/601; 211/188; 312/108; 312/111

[58] Field of Search ..... 52/561, 564, 648.1, 52/378, 379, 578, 579, 582.1, 588.1, 582.2, 601; 211/194, 188; 446/120; 312/108, 111, 265.5

[56] References Cited

U.S. PATENT DOCUMENTS

| | | | |
|---|---|---|---|
| 3,834,324 | 9/1974 | Lang | 211/188 X |
| 3,927,625 | 12/1975 | Lang | 211/194 X |
| 4,227,357 | 10/1980 | Newsom | 52/648.1 X |
| 4,304,079 | 12/1981 | Thorsten | 52/220.2 |
| 4,415,077 | 11/1983 | Murphy | 211/194 X |
| 4,903,453 | 2/1990 | Newsom | 52/578 X |
| 4,969,568 | 11/1990 | Yoshida | 403/171 X |
| 5,058,357 | 10/1991 | Newsom | 52/601 X |
| 5,499,726 | 3/1996 | Mitchell | 211/188 X |

*Primary Examiner*—Carl D. Friedman
*Assistant Examiner*—Winnie Yip
*Attorney, Agent, or Firm*—Harold Gell

[57] ABSTRACT

An earthquake and severe weather resistant, fail-safe building block and construction method for fabricating the blocks and structures therefrom. The blocks are hollow and include at least two subassemblies joined by interconnecting webs with provisions for single subassemblies to square off wall edges. Each subassembly includes upper and lower frames joined together by a plurality of structural columns perpendicular to the planes of the upper and lower frames. The upper and lower frames are dimensioned to form interfitting male and female receptacles that permit the blocks to be interconnected so that an assembly of blocks with structural integrity may be created by snapping together courses of blocks with each course staggered relative to the adjacent course. The frames incorporate "U" channels which receive the ends of the structural columns to secure each block assembly together in a manner which will not allow the columns to slip past the frames when subjected to vibration, torsion, or corrosion which breaks the bond between prior art block frames and associated vertical columns.

19 Claims, 5 Drawing Sheets

EARTHQUAKE AND WEATHER RESISTANT, FAIL-SAFE CONSTRUCTION BLOCK

FIELD OF THE INVENTION

This invention relates to interlocking building blocks and a method for building a structure by assembling a plurality of the interlocking building blocks.

BACKGROUND OF THE INVENTION

Historically, man has created structures from masonry blocks. This form of building traces its ancestry from the earliest structures which were piles of rock to contemporary cut stone systems and from sun baked brick to the contemporary trend of utilizing kiln fired bricks and cast cement blocks.

Structures utilizing masonry techniques has become increasingly costly due to the labor and energy involved in transporting the materials to the place of construction and erecting the structure. Masonry items such as brick, cut stone or concrete block are extremely heavy and a significant amount of energy is expended transporting them from their place of origin to the building site. Furthermore, skilled masons are required to lay up the building blocks, whether they be brick, stone or cement and mortar is required to secure the blocks together. Thus the cost of a masonry structure is a function of considerable energy expended in transporting the materials and a significant amount of skilled labor in handling the mortar and blocks.

A second contemporary means of constructions consists of fabricating a structure from a framework of sawn boards and covering the framework with siding and plaster board type materials. This latter method of construction is not as sturdy as the block construction and like the block system, does not provide adequate thermal insulation. Furthermore, the wooden structure is prone to fire and insect damage and it requires constant maintenance to prevent deterioration.

The obvious shortcomings of the foregoing building methods led to the improved construction method disclosed in U.S. Pat. No. 4,227,357 on "Construction Blocks" issued to Bobby G. Newsom on Oct. 14, 1980. In this system, skeletal blocks formed from heavy gauge rod or bar stock are provided with straight and hook projections that permit the blocks to be interconnected to form a structure which will receive furring strips or stringers. This concept provides a significant advancement to construction methods but fails to provide adequate strength for certain load bearing wall applications. Furthermore, the rods or bars forming the building blocks do not provide a means whereby wall board or other covering materials may be fastened to the structure. In the construction blocks of U.S. Pat. No. 4,227,357, furring strips are necessary to provide a surface for nailing or adhesively affixing materials to the structural wall.

The improved construction method disclosed in U.S. Pat. No. 4,227,357 on "Construction Blocks" issued to Bobby G. Newsom on Oct. 14, 1980 was not the final answer to problems with building blocks. Thus on Feb. 27, 1990 U.S. Pat. No. 4,903,543 was issued to Bob G. Newsom for "Construction Blocks". This patent teaches an improved block including upper and lower frames joined together by a plurality of structural columns perpendicular to the planes of the upper and lower frames. The upper and lower frames are dimensioned to form interfitting male and female receptacles that permit the blocks to be interconnected so that an assembly of blocks with structural integrity may be created by snapping together courses of blocks with each course staggered relative to the adjacent course. The new block lead to many improvements in the construction industry but it is subject to failure when subjected to the extreme vibration and torsion loads exerted by earthquakes, tornados, hurricanes and typhoons or under adverse corrosive environments. The forgoing can result in the bond between the frames and columns failing and such a failure results in the vertical collapse of the structure as the column elements of the blocks slide past their frames.

OBJECTIVES OF THE INVENTION

In view of the obvious shortcomings of the various contemporary building methods, it is an objective of this invention to provide a building block which may be assembled by an unskilled laborer without the aid of mortar to create structures having plumb walls and square corners and insulating and structural integrity that is greater than masonry techniques but requires less man power to assemble than a wood frame structure and which is resistant to vibration and torsion loads caused by earthquakes or severe weather and bond destroying corrosive environments.

A further objective of the present invention is to provide a building structure comprised of a plurality of interlocking blocks fabricated from vertical column elements joined together by upper and lower frames dimensioned to function as male and female interlocking members with "U" channels to receive the ends of the columns and prohibit slippage between the columns and frames even when the bonds there between are destroyed. Such blocks are referred herein as fail-safe blocks.

A still further objective of the present invention is to provide a method for fabricating a structure which includes assembling a number of blocks incorporating the above improvements.

A further objective of the present invention is to provide a method for fabricating a structure which includes assembling a number of blocks comprised of preformed hollow subassemblies including end frames forming male and female coupling means joined on opposite ends of each subassembly by "U" channel means. Another objective of the present invention is to provide a method for building a structure comprised of assembling fail-safe building blocks of the type described herein, inserting nailing strips in recesses provided therein, securing external and internal facing materials to the modules by nailing the facing materials to the nailing strips and filling the void between the internal and external facing panels with an insulating material.

Another objective of the present invention is to provide a method for building a structure comprised of assembling formed hollow module fail-safe building blocks, inserting nailing strips in recesses provided therein, securing external and internal facing materials to the modules by nailing the facing materials to the nailing strips and filling the void between the internal and external facing panels with an insulating material.

A still further objective of the present invention is to provide a method for building a structure comprised of assembling formed skeletal module fail-safe building blocks, inserting nailing strips in recesses provided therein, securing facing materials to one side of the modules by nailing the facing materials to the nailing strips and spraying a masonry or resinous insulating and weatherproofing material over the exposed side of the skeletal modules and back of the facing materials to complete a wall structure.

A still further objective of the present invention is to provide a method for building a structure comprised of assembling formed hollow module fail-safe building blocks, inserting nailing strips in recesses provided therein, securing facing materials to one side of the modules by nailing the facing materials to the nailing strips and spraying a masonry or resinous insulating and weatherproofing material over the exposed side of the hollow modules and back of the facing materials to complete a wall structure.

Another objective of the present invention is to provide a method for building a structure comprised of assembling fail-safe building blocks formed as skeletal modules and securing facing materials to the modules by an adhesive means applied to selected flat surfaces of the formed metal strips creating the modules.

Another objective of the present invention is to provide a method for building a structure comprised of assembling fail-safe building blocks formed as hollow modules and securing facing materials to the modules by an adhesive means applied to selected flat surfaces of the formed metal strips creating the modules.

Another objective of the present invention is to provide a method for building a structure comprised of assembling fail-safe building blocks formed as skeletal modules and securing facing materials to the modules by dry wall screws applied to selected flat surfaces of the formed metal strips creating the modules.

Another objective of the present invention is to provide a method for building a structure comprised of assembling fail-safe building blocks formed as hollow modules and securing facing materials to the modules by dry wall screws applied to selected flat surfaces of the formed metal strips creating the modules.

A still further objective of the present invention is to provide a building structure comprised of fail-safe building blocks formed as skeletal modules with facing materials secured by adhesive means to opposite sides of the modules and filling the void between facing panels with an insulating material.

A still further objective of the present invention is to provide a building structure comprised of fail-safe building blocks formed as hollow modules with facing materials secured by adhesive means to opposite sides of the modules and filling the void between facing panels with an insulating material.

The foregoing and other objectives of the invention will become apparent in light of the drawings, specification and claims contained herein.

SUMMARY OF THE INVENTION

Presented hereby is a fail-safe building block or module which is fabricated by forming galvanized metal strips, plastic, fiberglass, or any other suitable materials into vertical column elements and securing them together with top and bottom end frames designed to function as interfitting male and female connecting elements. The column element/frame interface includes "U" channels in the frames to hold the frames on the ends of the column elements even when all bonds there between are broken. This new form of building block structure has dimensions approximately equivalent to contemporary building blocks. The new building blocks include at least two subassemblies joined by interconnecting webs and may be skeletal or hollow.

DESCRIPTION OF THE INVENTION

Figure 1:
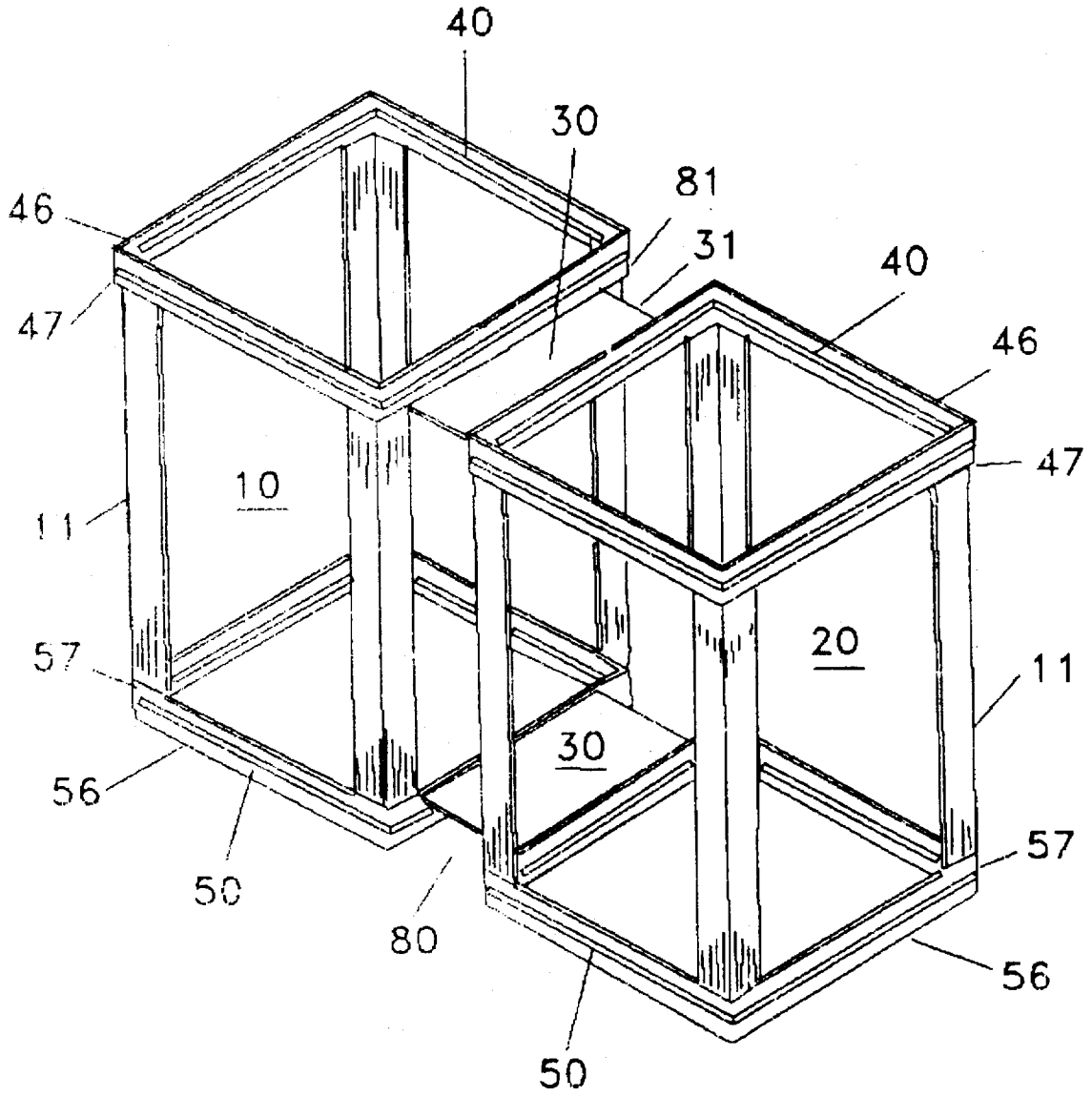
FIG. 1 is a ¾ view of a preferred embodiment of the fail-safe building block of the present invention.

FIG. 1 illustrates the basic, fail-safe skeletal building block of this invention. The block is comprised of a framework fabricated from metal, plastic, reinforced plastic or any other material capable of being formed into the required basic shapes. In the preferred embodiment, 28 gauge galvanized steel sheet material is used. Preferably, the steel sheet is galvanized after being cut and formed. Regardless of material used, its strength is calculated to meet the anticipated stress which will be encountered in the structure fabricated from a plurality of similar blocks. The use of galvanized metal in the preferred embodiment is presented as a convenient form in which to describe the invention. The different block elements can be fabricated from metal, plastic, fiberglass, boron filament, or a wide variety of materials having the required physical properties which will enable the creation of a strong and resilient structure.

The exemplary fail-safe building block illustrated in FIG. 1 is comprised of a top and bottom frame joined by a plurality of vertical column support members 11. The bottom frame includes a lower section defining the geometric foot print of the fail-safe construction block. The lower section constitutes one element of a male/female coupling. The bottom frame also includes an upper section including a "U" channel.

The bottom frame of the preferred embodiment is formed by first and second identical sub-frames 50, each of which has a lower section 56 defining a portion of the geometric foot print and constituting a separate element of a male/female coupling. Each sub-frame also includes an upper section 57 which includes a "U" channel.

Figure 4:
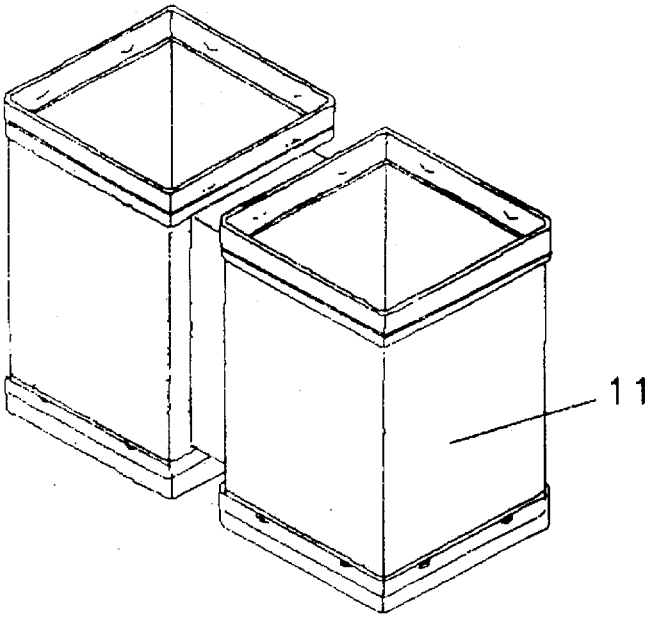
FIG. 4 is a ¾ view of an alternate embodiment of the building block of the present invention.
Figure 5:
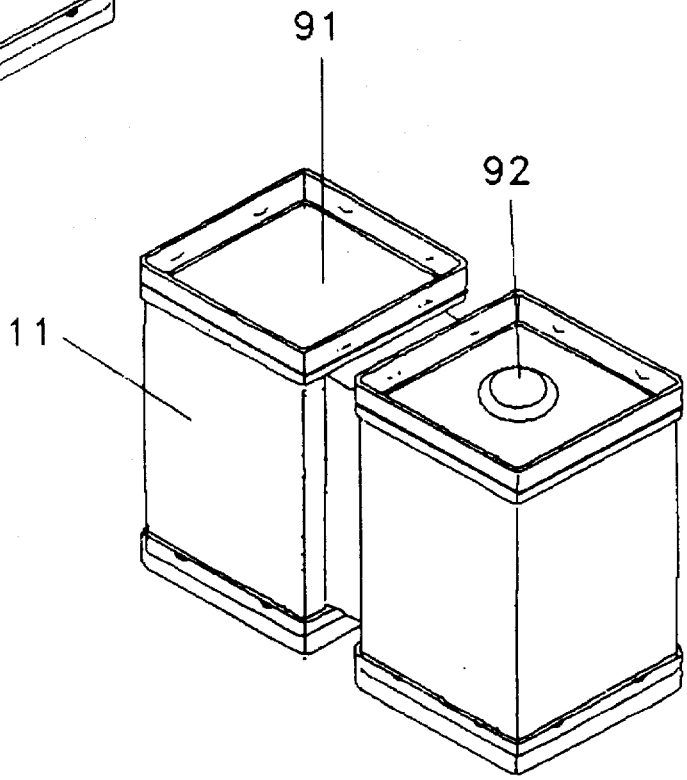
FIG. 5 is a modified form of the alternate embodiment illustrated in FIG. 4.

The top frame includes an upper section constituting the second element of the male/female coupling and a lower section including a "U" channel. It includes first and second identical sub-frames 40, each of which has an upper section 46 constituting a separate second element of the male/female coupling and a lower section 47 including a "U" channel;

The vertical column support members 11 join each top sub-frame with a bottom sub-frame to create two identical subassemblies 10 and 20 which are polyhedrons in the preferred embodiment. They are joined together by a pair of spacing webs 30. Each subassembly is a skeletal structure in the embodiment of FIG. 1 but the vertical support members 11 may be solid walls or merged into a tube to form alternate embodiments as illustrated in FIGS. 4 and 5.

The vertical support column members 11 are held together to form the subassemblies 10 and 20 by top frame members 40 and bottom frame members 50 as previously described. In the preferred embodiment the top frame members 40 function as female coupling elements that mate with bottom frame members 50 which function as male coupling elements when a plurality of blocks are arranged to form a structure.

Figure 2:
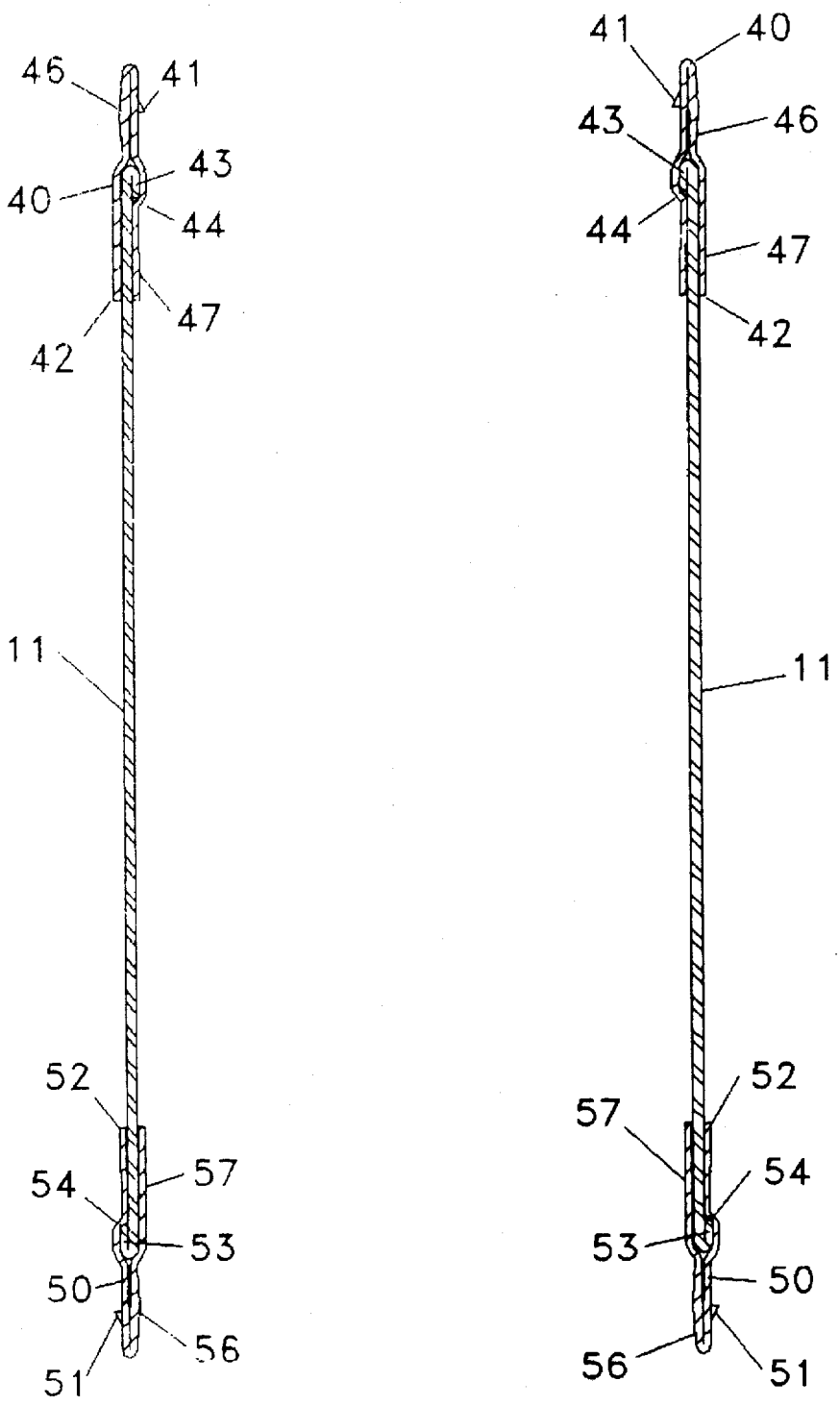
FIG. 2 is a sectional view of the fail-safe building block of FIG. 1 taken along line 1—1 to illustrate the "U" channels of the male and female frame ends taken through a D-lance snap-fit structure.

The top frames 40 of the subassemblies are identical and the mating bottom frames 50 are like wise identical but include mirror image structures to the top frames to facilitate the interlocking coupling of blocks desirable when assembling a structure therefrom. They each form a parallelogram in the preferred embodiment but may be any geometric shape, limited only by the requirement of having sides which match the sides of adjoining structures. They include latches formed in or affixed to the frame walls. The latches cooperate with latches in the coupled frame structure. FIG. 2 illustrates the interrelationship. In this sectional view, note that the top frame 40 is offset to the outside of the column members 11 and the bottom frame 50 is offset to the inside of the columns 11. The offsets are chosen so that the bottom or male frame 50 has an outside geometry which matches the inside geometry of the top frame 40, i.e. the inside of the top frame 40 is approximately the same size as the outside of the bottom frame 50.

FIG. 2 illustrates the latching means on both top and bottom frames. In the exemplary embodiment, D-lance snap fittings 41 are positioned to cooperate with D-lance snap fittings 51.

The novel feature which provides the fail-safe quality of the blocks constructed according to the invention can best be seen in FIG. 2. The "U" channels 42 and 52 receive the ends of the columns 11 so that when the block is under compression, the columns cannot slip past the frame ends even if the bond between column and frame is broken as can happen in the spot welded assemblies incorporated in prior devices. Integrity is further increased by folds 43 and 53 at the ends of the columns 11 that assist in locking the frames to the columns when the "U" channels 42 and 52 are crimped or pressure formed against both sides of the columns. The forming, 44 and 54, of the material of the frames about the folded ends, 43 and 53, of the columns eliminates the need for welding or other forms of bonding in assembling the blocks.

The spacers 30 joining the frames may be secured by 90 degree flanges bonded to the outside of the frames but in the embodiment illustrated by FIG. 1, the flanges are folded on their end like the ends of the columns, see FIG. 2, and crimped in the "U" channels 42 or 52.

Figure 3:
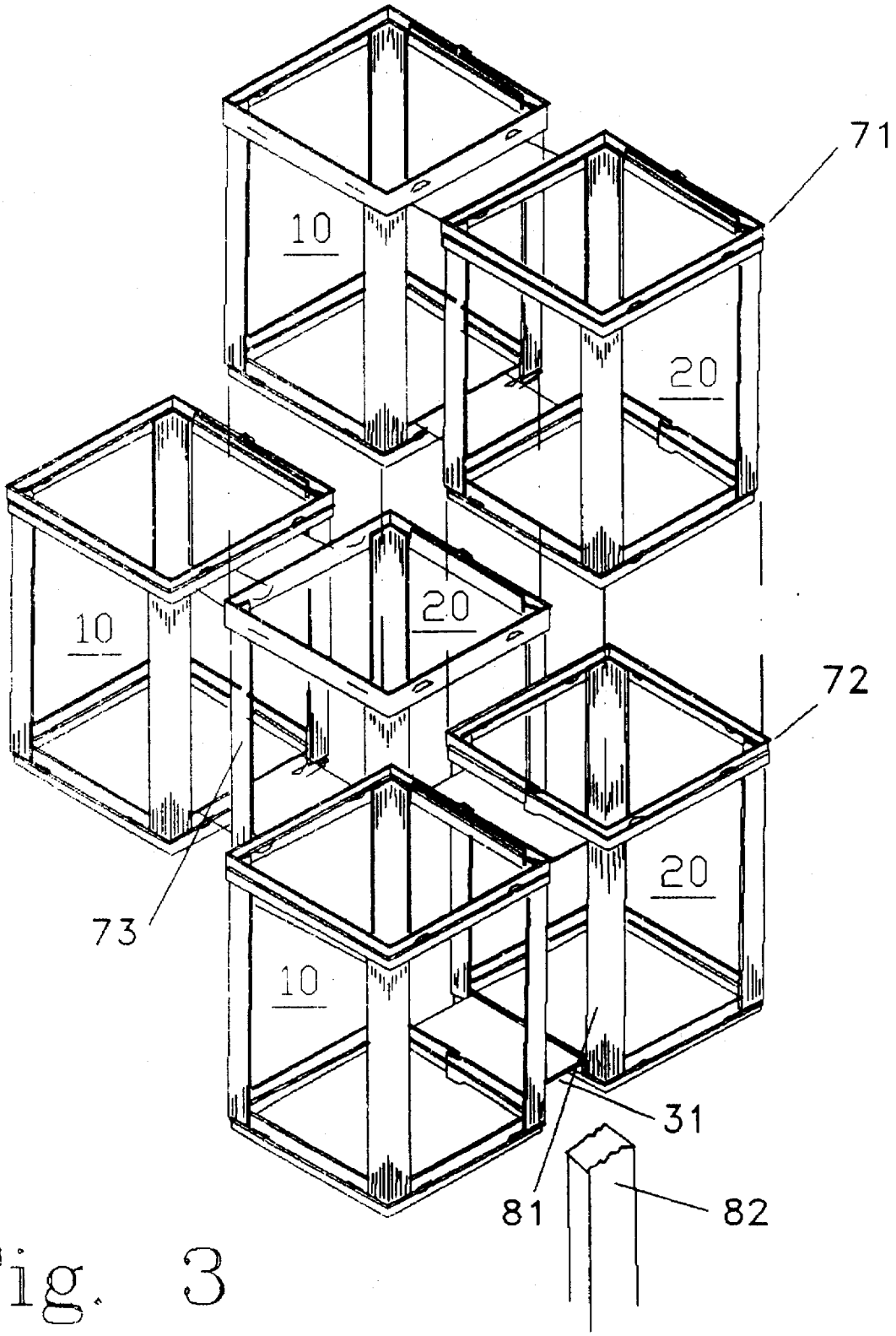
FIG. 3 is an exploded view of fail-safe block assemblies arranged to form a 90 degree corner.
Figure 3A:
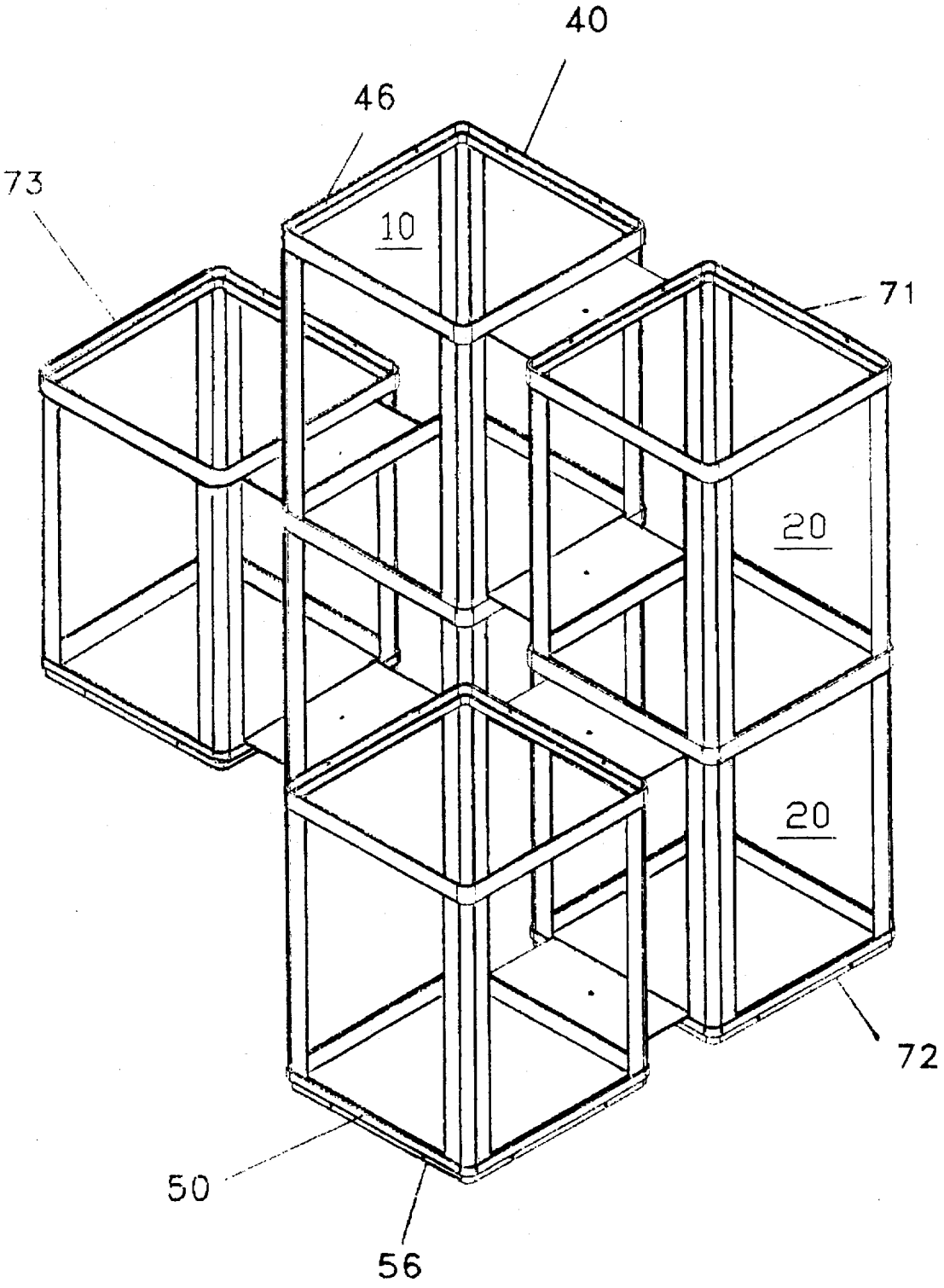
FIG. 3A illustrates the exploded view of FIG. 3 is its assembled form.

Nesting of two block assemblies to create a wall is illustrated in FIG. 3. Subassembly 20 of block 71 is inserted into subassembly 20 of block 72 and subassembly 10 of block 71 is inserted into subassembly 20 of block 73 to create a staggered interlocked corner structure to begin construction of two intersecting walls using the classical masonry technique of building from the corners toward the wall centers.

Single, unattached subassemblies are provided to square off wall ends when needed. Such single blocks are identical to subassemblies 10 or 20. Loose spacers 30 are used to attach single subassembly blocks to adjacent blocks. The loose spacers are sized to fit over the frames of adjacent blocks to lock the construction together.

A D-lance arrangement is illustrated to provide a snap fit for the two frames but other mechanical fasteners such as screws, nuts and bolts, rivets, glue or nails may be used. The D-lance, 41 or 51, is created by horizontal cuts through the frame material and deformation of the material adjacent to the slits. This creates an arcuate projection which locks into an opening in a mating frame member. In the preferred embodiment, the opening receiving the arcuate projection of a mating frame is created by the slit/deformation process which creates an arcuate interlocking projection in the receiving frame.

When a plurality of blocks are assembled with the top and bottom frames of the subassemblies nested or interconnected together, a structural wall having significant load bearing properties is created. In a preferred embodiment, the blocks are set so that the top frame receives the bottom frame of the next course of blocks in a staggered interlock arrangement as illustrated in FIG. 3. This results in a structure having vertical channels dimensioned as a function of spacing web members 30 which may be used to support floor joists or roof truss members. Studs, such as wood 1×2's or metal studs are also set into these channels. In the fabrication of the basic blocks, the spacers are dimensioned so that the end product will match the type of stringer or stud that is to be used in the wall assembly. That is, the length of the spacer creates a space, 80, between vertical members of adjacent subassemblies 10 and 20 which equals the width of the studs to be used, see FIG. 1. The width of the spacer is controlled so the distance between its edge 31 and block face 81 equals the depth of the stud.

The use of metal or wood studs 82 provides a nailing surface for wall sheathing as well as structural integrity for the assembled wall. If desired, the wall sheathing may be secured directly to the blocks by adhesives or any of a number of mechanical fasteners such as nuts and bolts, rivets, screws, dry wall screws, spring clips etc.

When mechanical fastening devices such as screws are used to hold a wall sheathing to the basic skeletal structure, the snap fittings 41 and 51 may be eliminated in favor of securing the blocks together by the same mechanical device which secures the wall sheathing to the structure. If additional security is required, additional mechanical fasteners such as nuts and bolts, rivets, screws or clamps may be used in addition to those securing the sheathing to the structure.

Alternate embodiments of the fail-safe building block are illustrated in FIGS. 4 and 5. In FIG. 4 the column members 11 are as wide as the sides of the subassembly to create open ended tubes which may be filled with insulation or structural material such as concrete and reinforcing steel bars. In FIG. 5 the column members 11 of a subassembly are replaced a tube to create a structure similar the that illustrated by FIG. 4. The ends of the tubes may be sealed by plates to provide containers and selected plates may be fitted with removable caps 92.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim is:

1. A construction unit comprising fail-safe construction blocks wherein each of said fail-safe construction block comprises:

a bottom frame including a bottom frame lower section defining the geometric foot print of said fail-safe construction block and constituting one element of a male/female coupling and a bottom frame upper section including a "U" channel;

a top frame including a top frame upper section constituting a second element of said male/female coupling and a top frame lower section including a "U" channel;

a plurality of panels, each of which includes an upper edge positioned within said "U" channel of said top frame and a lower edge positioned within said "U" channel of said lower frame; and said top and bottom frames include interlocking means on sides of said frames for engaging mating interlocking means of the other similar block when said top and bottom frames of two similar fail-safe construction blocks are interfit one over the other, said interlocking means interlocks said fail-safe construction blocks.

2. A construction unit as defined by claim 1, wherein said bottom frame of said fail-safe construction block includes first and second sub-frames, each of which includes a sub-frame bottom frame lower section defining a portion of said geometric foot print of said fail-safe construction block and constituting one element of a male/female coupling and a sub-frame bottom frame upper section including a "U" channel; and said top frame of said fail-safe construction block includes first and second sub-frames, each of which includes a sub-frame top frame upper section constituting a second element of said male/female coupling and a sub-frame top frame lower section including a "U" channel;

a first subassembly comprising a portion of said plurality of panels distributed between said bottom frame first sub-frame and said top frame first sub-frame; and a second subassembly comprising a portion of said plurality of panels distributed between said bottom frame second sub-frame and said top frame second sub-frame.

3. A construction unit as defined by claim 2, comprising:

a spacing means for joining said first and said second subassemblies together.

4. A construction unit as defined by claim 3 wherein each of said subassemblies constitutes a polyhedra.

5. A construction unit as defined by claim 3 wherein said portion of said plurality of panels distributed between said bottom frame first sub-frame and said top frame first sub-frame are merged together to form a first tube; and said portion of said plurality of panels distributed between said bottom frame second sub-frame and said top frame second sub-frame are merged together to form a second tube.

6. A construction unit as defined by claim 5, comprising means for sealing an end of one of said tubes.

7. A construction unit as defined by claim 6, comprising a reclosable opening in said means for sealing an end of one of said tubes.

8. A construction unit as defined by claim 1 wherein said interlocking means include deformable means for engaging mating deformable means when said top and bottom frames of two similar construction blocks are interfit one over the other, said deformable means adapted to interlock said construction blocks.

9. A construction unit as defined by claim 1, comprising, a plurality of courses of said fail-safe construction blocks interconnected to form a series of blocks creating an integral wall unit.

10. A construction block, comprising:

a bottom frame including a lower section constituting one element of a male/female coupling and an upper section including a "U" channel;

a top frame including an upper section constituting a second element of said male/female coupling and a lower section including a "U" channel;

a plurality of panels, each of which includes an upper edge positioned within said "U" channel of said top frame and a lower edge positioned within said "U" channel of said lower frame; and said top and bottom frames include interlocking means on sides of said frames for engaging mating interlocking means of a similar fail-safe construction block when said top and bottom frames of two similar construction blocks are interfit one over the other; said interlocking means adapted to interlock said construction blocks.

11. A construction block, as defined by claim 10 wherein said upper and lower edges of at least one of said panels includes means for locking said edge within said "U" channel when said "U" channel is deformed about said panel.

12. A fail-safe construction block as defined by claim 10 wherein said interlocking means include deformable means for engaging mating deformable means when said top and bottom frames of two similar construction blocks are interfit one over the other, said deformable means adapted to interlock said construction blocks.

13. A construction block as defined by claim 10, comprising:

a first subassembly comprising construction blocks as defined by claim 11, a second subassembly identical to said first subassembly; and means for joining said first and second subassemblies to form a unitary construction block including a pair of identical block structures.

14. A construction block as defined by claim 13, wherein said means for joining said first and said second subassemblies includes a spacing means.

15. A construction block as defined by claim 13 wherein each of said subassemblies constitutes a polyhedra.

16. A construction block as defined by claim 10 wherein said plurality of panels are merged together to form a tube.

17. A construction block as defined by claim 16, comprising:

a first subassembly comprising construction blocks as defined by claim 16;

a second subassembly identical to said first subassembly; and means for joining said first and second subassemblies to form a unitary construction block including a pair of identical block structures.

18. A construction block as defined by claim 16, comprising means for sealing an end of said tube; and a reclosable opening in said means for sealing an end of said tube.

19. A construction unit comprising a fail-safe construction block, comprising:

a bottom frame including first and second sub-frames, each of which includes a lower section defining a portion of the geometric foot print of a construction block and constituting one element of a male/female coupling and an upper section including a "U" channel;

a top frame including first and second sub-frames, each of which includes an upper section constituting a second element of said male/female coupling and a lower section including a "U" channel;

a plurality of panels, each of which includes an upper edge positioned within said "U" channel of said top frame and a lower edge positioned within said "U" channel of said lower frame;

a spacing means for joining said first and said second sub-frames together; and said top and bottom frames include deformable means on sides of said frames for engaging mating deformable means of a similar construction block when said top and bottom frames of two similar construction blocks are interfit one over the other, said deformable means adapted to interlock said construction blocks.

* * * * *